US011155906B2

(12) United States Patent
Kim et al.

(10) Patent No.: US 11,155,906 B2
(45) Date of Patent: Oct. 26, 2021

(54) PRESSURE VESSEL STEEL HAVING EXCELLENT HYDROGEN INDUCED CRACKING RESISTANCE, AND MANUFACTURING METHOD THEREFOR

(71) Applicant: POSCO, Pohang-si (KR)

(72) Inventors: Dae-Woo Kim, Pohang-si (KR); Jong-Kyo Choi, Seoul (KR); Young-Jin Jung, Pohang-si (KR)

(73) Assignee: POSCO, Pohang-si (KR)

( * ) Notice: Subject to any disclaimer, the term of this patent is extended or adjusted under 35 U.S.C. 154(b) by 126 days.

(21) Appl. No.: 16/349,084

(22) PCT Filed: Nov. 3, 2017

(86) PCT No.: PCT/KR2017/012414

§ 371 (c)(1),
(2) Date: May 10, 2019

(87) PCT Pub. No.: WO2018/088761

PCT Pub. Date: May 17, 2018

(65) Prior Publication Data

US 2019/0264306 A1 Aug. 29, 2019

(30) Foreign Application Priority Data

Nov. 11, 2016 (KR) ..... 10-2016-0150280

(51) Int. Cl.
*C22C 38/48* (2006.01)
*C21D 9/46* (2006.01)
(Continued)

(52) U.S. Cl.
CPC ..... *C22C 38/48* (2013.01); *B21B 1/22* (2013.01); *B21B 3/02* (2013.01); *B21B 37/74* (2013.01);
(Continued)

(58) Field of Classification Search
CPC .... C21D 2211/002; C21D 6/00; C21D 6/001; C21D 6/002; C21D 6/004; C21D 6/005;
(Continued)

(56) References Cited

U.S. PATENT DOCUMENTS

2011/0129381 A1* 6/2011 Hasegawa ..... C22C 38/12 420/83
2013/0224063 A1* 8/2013 Kim ..... C21D 8/0205 420/84
(Continued)

FOREIGN PATENT DOCUMENTS

CN 108368591 A 8/2018
GN 104745952 A 7/2015
(Continued)

OTHER PUBLICATIONS

International Search Report dated Feb. 7, 2018 issued in corresponding International Patent Application No. PCT/KR2017/012414.
(Continued)

*Primary Examiner* — Vanessa T. Luk

(74) *Attorney, Agent, or Firm* — Morgan, Lewis & Bockius LLP

(57) ABSTRACT

The present invention relates to pressure vessel steel to be used in a hydrogen sulfide atmosphere, and relates to pressure vessel steel having excellent resistance to hydrogen induced cracking (HIC), and a manufacturing method therefor.

6 Claims, 1 Drawing Sheet

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/00*** | (2006.01) |
| ***B21B 3/02*** | (2006.01) |
| ***B21B 37/74*** | (2006.01) |
| ***C22C 38/40*** | (2006.01) |
| ***B21B 1/22*** | (2006.01) |

(52) U.S. Cl.
CPC ..... *C21D 8/0226* (2013.01); *C21D 9/46* (2013.01); *C22C 38/00* (2013.01); *C22C 38/02* (2013.01); *C22C 38/04* (2013.01); *C22C 38/06* (2013.01); *C22C 38/40* (2013.01); *C22C 38/42* (2013.01); *C22C 38/44* (2013.01); *C22C 38/46* (2013.01); *C21D 8/0205* (2013.01); *C21D 8/0247* (2013.01); *C21D 2211/002* (2013.01); *C21D 2211/005* (2013.01)

(58) Field of Classification Search
CPC ..... C21D 6/007; C21D 6/008; C21D 9/46; C21D 9/48; C21D 9/50
See application file for complete search history.

(56) References Cited

U.S. PATENT DOCUMENTS

| | | | | |
|---|---|---|---|---|
| 2015/0329950 | A1* | 11/2015 | Azuma | C22C 38/38 148/533 |
| 2015/0368737 | A1 | 12/2015 | Goto et al. | |
| 2018/0119240 | A1* | 5/2018 | Tanaka | C22C 38/02 |
| 2018/0371567 | A1 | 12/2018 | Hong | |

FOREIGN PATENT DOCUMENTS

| | | | | |
|---|---|---|---|---|
| GN | 105177452 | A | 12/2015 | |
| JP | H05-287442 | A | 11/1993 | |
| JP | 06-179910 | A | 6/1994 | |
| JP | 11-189840 | A | 7/1999 | |
| JP | 2003-013175 | A | 1/2003 | |
| JP | 2014-005534 | A | 1/2014 | |
| KR | 10-0723166 | B1 | 5/2007 | |
| KR | 10-2010-0076727 | A | 7/2010 | |
| KR | 10-2013-0076569 | A | 7/2013 | |
| KR | 10-2013-0077906 | A | 7/2013 | |
| KR | 10-2013-0134338 | A | 12/2013 | |
| KR | 10-2015-0074944 | A | 7/2015 | |
| KR | 10-2015-0088320 | A | 7/2015 | |
| KR | 10-2016-0036991 | A | 4/2016 | |
| KR | 10-2016-0075925 | A | 6/2016 | |
| WO | WO-2014132968 | A1 * | 9/2014 | C22C 38/38 |
| WO | WO-2016157896 | A1 * | 10/2016 | C22C 38/28 |

OTHER PUBLICATIONS

Chinese Office Action dated Jun. 23, 2020 issued in Chinese Patent Application No. 201780069473.9.
Japanese Office Action dated Aug. 18, 2020 issued in Japanese Patent Application No. 2019-524050.

* cited by examiner

PRESSURE VESSEL STEEL HAVING EXCELLENT HYDROGEN INDUCED CRACKING RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/012414, filed on Nov. 3, 2017, which in turn claims the benefit of Korean Patent Application No. 10-2016-0150280, filed Nov. 11, 2016, the entire disclosures of which applications are incorporated by reference herein.

TECHNICAL FIELD

The present disclosure relates to a pressure vessel steel for use in a hydrogen sulfide atmosphere, and more particularly, to a pressure vessel steel having high resistance to hydrogen induced cracking (HIC) and a method for manufacturing the pressure vessel steel.

BACKGROUND ART

In recent years, pressure vessel steels for applications such as petrochemical production facilities and storage tanks have been faced with an increase in facility size and steel material thickness caused by the increase in operation times, and there is a trend for lowering the carbon equivalent (Ceq) of steel and extremely controlling impurities included in steel so as to guarantee the structural stability of base metals and weld zones when manufacturing large structures.

In addition, due to the increased production of crude oil containing a large amount of $H_2S$, it is more difficult to guarantee quality because of hydrogen induced cracking (HIC).

In particular, steels used in plant facilities for mining, processing, transporting, and storing low-quality crude oil are required to have an ability of suppressing the formation of cracks caused by wet hydrogen sulfide contained in crude oil.

In addition, environmental pollution becomes a global issue in the case of plant facility accidents, and astronomical costs may be incurred in recovery from the accident. Therefore, HIC resistance requirements on steel materials have become stricter in the energy industry.

HIC occurs in steel by the following principle.

As a steel sheet comes into contact with wet hydrogen sulfide contained in crude oil, the steel sheet corrodes, and hydrogen atoms generated by the corrosion penetrate and diffuse into the steel sheet and exist in an atomic state in the steel sheet. Thereafter, the hydrogen atoms combine with hydrogen molecules and form hydrogen gas in the steel sheet, thereby generating gas pressure which causes brittle cracks in weak structures (e.g., inclusions, segregation zones, internal voids, etc.) of the steel sheet. Such brittle cracks gradually grow, and if the growth continues to the extent beyond the strength of the steel sheet, the steel sheet factures.

Thus, the following techniques have been proposed as methods for improving the HIC resistance of steel used in a hydrogen sulfide atmosphere.

First, a method of adding an element such as copper (Cu) has been proposed. Secondly, there has been proposed a method of minimizing or shape controlling hard structures (such as pearlite) in which cracking easily occurs and propagates. Thirdly, there has been proposed a method of controlling internal defects such as internal inclusions and voids that may act as sites of hydrogen concentration and crack initiation. Fourthly, there has been proposed a method of improving resistance to crack initiation by changing a processing process to form a hard structure such as tempered martensite or tempered bainite as a matrix through a water treatment such as normalizing accelerated cooling tempering (NACT), QT, or DOT.

The technique of adding copper (Cu) is effective in improving resistance to HIC by forming a stable CuS film on the surface of a material in a weakly acidic atmosphere and thus reducing the penetration of hydrogen into the material. However, it is known that the effect of copper (Cu) addition is not significant in a strongly acidic atmosphere, and, moreover, the addition of copper (Cu) may cause high-temperature cracking and surface cracking in steel sheets and may thus increase process costs because of the addition of, for example, a surface polishing process.

The method of minimizing or shape controlling hard structures is mainly for delaying the propagation of cracks by reducing the band index (BI) of a banded structure formed in a matrix after normalizing heat treatment.

With regard thereto, Patent Document 1 discloses that steel having a tensile strength grade of 500 MPa and high HIC resistance may be obtained by forming a ferrite+pearlite microstructure having a band index of 0.25 or less by controlling the alloying composition of a slab and processing the slab through a heating process, a hot rolling process, an air cooling process at room temperature, a heating process in the temperature range of an Ac1 transformation point to an Ac3 transformation point, and then a slow cooling process on the slab.

However, in the case of thin materials having a thickness of 25 mm or less, a large amount of rolling is required to obtain a final product thickness from a slab, and thus, a Mn-rich layer in the slab is arranged in the form of a strip in a direction parallel to the direction of rolling after a hot rolling process. In addition, although an austenite single phase is obtained at a normalizing temperature, since the shape and concentration of the Mn-rich layer are not changed, a hard banded structure is reformed during the air cooling process after heat treatment.

The third method is to increase HIC resistance by increasing the cleanliness of a slab by minimizing inclusions and voids included in the slab.

For example, Patent Document 2 discloses that a steel material having high HIC resistance may be manufactured by adjusting the content of calcium (Ca) to satisfy the relationship $0.1 \leq (T \cdot [Ca] - (17/18) \times T \cdot [O] - 1.25 \times S)/T[O] \leq 0.5)$ when adding calcium (Ca) to molten steel.

Calcium (Ca) may improve HIC resistance to some degree because calcium (Ca) spheroidizes the shape of MnS inclusions that may become the starting points of HIC and forms CaS by reacting with sulfur (S) included in steel. However, if an excessively large amount of calcium (Ca) is added or the ratio of Ca to $Al_2O_3$ is not proper, in particular, if the content of CaO is high, HIC resistance may decrease. Furthermore, in the case of thin materials, coarse oxide inclusions may be crushed according to the composition and shape of the coarse oxide inclusions due to a large accumulated amount of rolling in a rolling process, and at the end, the inclusions may be lengthily scattered in the direction of rolling. In this case, the degree of stress concentration is very high at ends of the scattered inclusions because of the partial pressure of hydrogen, and thus HIC resistance decreases.

The fourth method is to form a hard matrix such as acicular ferrite, bainite, or martensite through a water treatment process such as TMCP instead of forming a ferrite+pearlite matrix.

With regard thereto, Patent Document 3 discloses that HIC resistance may be improved by controlling the alloying composition of a slab and processing the slab through a heating process, a finish rolling process within the temperature range of 700° C. to 850° C., an accelerated cooling process within the temperature range of Ar3-30° C. or greater, and a finishing process within the temperature range of 350° C. to 550° C.

In Patent Document 3, bainite or acicular ferrite is formed through a general TMCP by performing non-recrystallization region rolling with an increase reduction ratio and then performing accelerated cooling, and HIC resistance is improved by increasing the strength of a matrix and preventing the formation of a banded structure vulnerable to crack propagation.

However, if the alloying composition, controlled rolling, and cooling conditions disclosed in Patent Document 3 are applied, it is difficult to guarantee proper strength after post weld heat treatment (PWHT), usually performed on pressure vessel steels. In addition, due to high-density dislocations occurring when a low-temperature phase is formed, a region to which PWHT is not, or not yet, applied, may be vulnerable to initiation of cracks. In particular, work hardening increases in a pipe-making process for manufacturing pressure vessels, and thus HIC characteristics of pipe materials are further worsened.

Therefore, the above-described methods of the related art have limitations in manufacturing pressure vessel steels having a tensile strength grade of 550 MPa and HIC resistance after PWHT.

(Patent Document 1) Korean Patent Application Laid-open Publication No. 2010-0076727

(Patent Document 2) Japanese Patent Application Laid-open Publication No. 2014-005534

(Patent Document 3) Japanese Patent Application Laid-open Publication No. 2003-013175

DISCLOSURE

Technical Problem

Aspects of the present disclosure may provide a steel having a strength grade of 550 MPa and high resistance to hydrogen induced cracking (HIC) after post weld heat treatment (PWHT) owing to optimization in alloying composition and manufacturing conditions, and a method for manufacturing the steel.

Technical Solution

According to an aspect of the present disclosure, there is provided a pressure vessel steel having high resistance to hydrogen induced cracking, the pressure vessel steel including, by wt %, carbon (C): 0.06% to 0.25%, silicon (Si): 0.05% to 0.50%, manganese (Mn): 1.0% to 2.0%, aluminum (Al): 0.005% to 0.40%, phosphorus (P): 0.010% or less, sulfur (S): 0.0015% or less, niobium (Nb): 0.001% to 0.03%, vanadium (V): 0.001% to 0.03%, titanium (Ti): 0.001% to 0.03%, chromium (Cr): 0.01% to 0.20%, molybdenum (Mo): 0.05% to 0.15%, copper (Cu): 0.02% to 0.50%, nickel (Ni): 0.05% to 0.50%, calcium (Ca): 0.0005% to 0.0040%, and the balance of iron (Fe) and inevitable impurities, wherein the pressure vessel steel has a microstructure including bainite having a dislocation density of $5\times10^{14}$ to $10^{15}/m^2$ in a fraction of 80% or greater and the balance of ferrite (excluding 0%).

According to another aspect of the present disclosure, there is provided a method for manufacturing a pressure vessel steel having high resistance to hydrogen induced cracking, the method including: preparing a steel slab having the above-described alloying composition; reheating the steel slab to a temperature of 1150° C. to 1200° C.; rough rolling the reheated steel slab at a temperature of 900° C. to 1100° C.; finish hot rolling the rough-rolled steel slab at a temperature of Ar3+80° C. to Ar3+300° C. to manufacture a hot-rolled steel sheet; cooling the hot-rolled steel sheet to a temperature of 450° C. to 500° C. at a cooling rate of 3° C./s to 200° C./s; and cooling the cooled hot-rolled steel sheet to a temperature of 200° C. to 250° C. by a stack cooling method and then maintaining the hot-rolled steel sheet for 80 hours to 120 hours.

Advantageous Effects

The present disclosure may provide a steel which has high resistance to hydrogen induced cracking (HIC) and a tensile strength grade of 550 MPa even after post weld heat treatment (PWHT) and is suitable for manufacturing pressure vessels.

BEST MODE

Figure 1A:
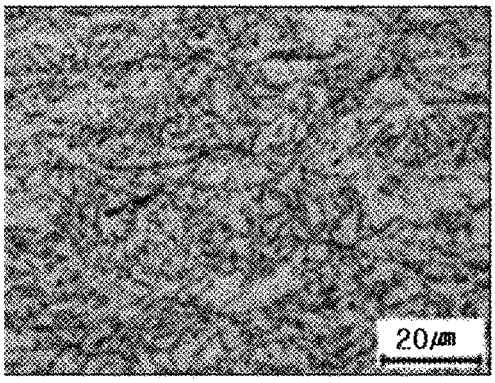
FIGS. 1A and 1B show images of the microstructures of Comparative Example 6 (FIG. 1A) and Inventive Example 5 (FIG. 1B).

The inventors have conducted intensive studies to provide a steel having a tensile strength grade of 550 MPa and high resistance to hydrogen induced cracking (HIC) for applications such as purification, transportation, and storage of crude oil. As a result, the inventors have found that a pressure vessel steel, which does not decrease in strength after post weld heat treatment (PWHT) and has high HIC resistance, could be provided if low-dislocation-density bainite is included as a matrix in the microstructure of the pressure vessel steel by optimizing the composition and manufacturing conditions of the pressure vessel steel. Based on this knowledge, the inventors have invented the present invention.

Specifically, according to an aspect of the present disclosure, a pressure vessel steel may preferably include, by wt %, carbon (C): 0.06% to 0.25%, silicon (Si): 0.05% to 0.50%, manganese (Mn): 1.0% to 2.0%, aluminum (Al): 0.005% to 0.40%, phosphorus (P): 0.010% or less, sulfur (S): 0.0015% or less, niobium (Nb): 0.001% to 0.03%, vanadium (V): 0.001% to 0.03%, titanium (Ti): 0.001% to 0.03%, chromium (Cr): 0.01% to 0.20%, molybdenum (Mo): 0.05% to 0.15%, copper (Cu): 0.02% to 0.50%, nickel (Ni): 0.05% to 0.50%, and calcium (Ca): 0.0005% to 0.0040%.

In the following description, reasons for adjusting the alloying composition of the pressure vessel steel as described above will be described in detail. In the following description, the content of each element is given in wt % unless otherwise specified.

C: 0.06% to 0.25%

Carbon (C) is a key element for securing the strength of steel, and thus it is preferable that carbon (C) is contained in steel within an appropriate range.

In the present disclosure, desired strength may be obtained when carbon (C) is added in an amount of 0.06% or greater. However, if the content of carbon (C) exceeds 0.25%, center segregation may increase, and a phase such as martensite or MA may be formed instead of low-dislocation-density bainite or ferrite after accelerated cooling to result in an excessive increase in strength or hardness. In particular, MA worsens HIC characteristics.

Therefore, according to the present disclosure, preferably, the content of carbon (C) may be adjusted to within the range of 0.06% to 0.25%, more preferably within the range of 0.10% to 0.20%, and even more preferably within the range of 0.10% to 0.15%.

Si: 0.05% to 0.50%

Silicon (Si) is a substitutional element which improves the strength of steel by solid solution strengthening and has a strong deoxidizing effect, and thus silicon (Si) is required for manufacturing clean steel. To this end, it is preferable to add silicon (Si) in an amount of 0.05% or greater. However, if the content of silicon (Si) is excessively high, MA may be generated, and the strength of a ferrite matrix may be excessively increased, thereby deteriorating HIC characteristics and impact toughness. Thus, it may be preferable to set the upper limit of the content of silicon (Si) to 0.50%.

Therefore, according to the present disclosure, preferably, the content of silicon (Si) may be adjusted to be within the range of 0.05% to 0.50%, more preferably within the range of 0.05% to 0.40%, and even more preferably within the range of 0.20% to 0.35%.

Mn: 1.0% to 2.0%

Manganese (Mn) is an element that improves strength by solid solution strengthening and improves hardenability for the formation of a low temperature transformation phase. In addition, since manganese (Mn) improves hardenability and thus enables the formation of a low temperature transformation phase even at a low cooling rate, manganese (Mn) functions as a key element for guaranteeing the formation of low-temperature bainite during air cooling after normalizing heat treatment.

To this end, it is preferable to add manganese (Mn) in an amount of 1.0% or greater. However, if the content of manganese (Mn) exceeds 2.0%, center segregation increases, and thus manganese (Mn) forms a large amount of MnS inclusions together with sulfur (S). Therefore, HIC resistance decreases due to the MnS inclusions.

Therefore, according to the present disclosure, the content of manganese (Mn) may be preferably limited to the range of 1.0% to 2.0%, more preferably to the range of 1.0% to 1.7%, and even more preferably to the range of 1.0% to 1.5%.

Al: 0.005% to 0.40%

Aluminum (Al) and silicon (Si) function as strong deoxidizers in a steel making process, and to this end, it may be preferable to add aluminum (Al) in an amount of 0.005% or greater. However, if the content of aluminum (Al) exceeds 0.40%, the fraction of $Al_2O_3$ excessively increases among oxide inclusions produced as a result of deoxidation. Thus, $Al_2O_3$ coarsens, and it becomes difficult to remove $Al_2O_3$ in a refining process. As a result, HIC resistance decreases due to oxide inclusions.

Therefore, according to the present disclosure, preferably, the content of aluminum (Al) may be adjusted to be within the range of 0.005% to 0.40%, more preferably within the range of 0.1% to 0.4%, and even more preferably within the range of 0.1% to 0.35%.

P and S: 0.010% or Less, and 0.0015% or Less, Respectively

Phosphorus (P) and sulfur (S) are elements that induce brittleness in grain boundaries or cause brittleness by forming coarse inclusions. Thus, it may be preferable that the contents of phosphorus (P) and sulfur (S) be limited to 0.010% or less, and 0.0015% or less, respectively, in order to improve resistance to brittle crack propagation.

Nb: 0.001% to 0.03% Niobium (Nb) precipitates in the form of NbC or NbCN and thus improves the strength of a base metal. In addition, niobium (Nb) increases the temperature of recrystallization and thus increases the amount of reduction in non-recrystallization region rolling, thereby having the effect of reducing the size of initial austenite grains.

To this end, it may be preferable to add niobium (Nb) in an amount of 0.001% or greater. However, if the content of niobium (Nb) is excessively high, unsolved niobium (Nb) forms TiNb(C,N) which causes UT defects and deterioration of impact toughness and HIC resistance. Therefore, it may be preferable that the content of niobium (Nb) be adjusted to be 0.03% or less.

Therefore, according to the present disclosure, preferably, the content of niobium (Nb) may be adjusted to be within the range of 0.001% to 0.03%, more preferably within the range of 0.005% to 0.02%, and even more preferably within the range of 0.007% to 0.015%.

V: 0.001% to 0.03%

Vanadium (V) is almost completely resolved in a slab reheating process, thereby having a poor precipitation strengthening effect or solid solution strengthening effect in a subsequent rolling process. However, vanadium (V) precipitates as very fine carbonitrides in a heat treatment process such as a PWHT process, thereby improving strength. In addition, vanadium (V) improves hardenability in an accelerated cooling process, thereby having the effect of increasing the fraction of low-dislocation-density bainite.

To this end, vanadium (V) may be added in an amount of 0.001% or greater. However, if the content of vanadium (V) exceeds 0.03%, the strength and hardness of weld zones are excessively increased, and thus surface cracks may be formed in a pressure vessel machining process. Furthermore, in this case, manufacturing costs may sharply increase, and thus it may not be economical.

Therefore, according to the present disclosure, the content of vanadium (V) may be preferably limited to the range of 0.001% to 0.03%, more preferably to the range of 0.005% to 0.02%, and even more preferably to the range of 0.007% to 0.015%.

Ti: 0.001% to 0.03%

Titanium (Ti) precipitates as TiN during a slab reheating process, thereby suppressing the growth of grains of a base metal and weld heat affected zones and markedly improving low-temperature toughness.

To this end, it may be preferable that the content of titanium (Ti) be 0.001% or greater. However, if the content of titanium (Ti) is greater than 0.03%, a continuous casting nozzle may be clogged, or low-temperature toughness may decrease due to central crystallization. In addition, if titanium (Ti) combines with nitrogen (N) and forms coarse TiN precipitates in a thicknesswise center region, the TiN precipitates may function as initiation points of HIC.

Therefore, according to the present disclosure, the content of titanium (Ti) may be preferably limited to the range of 0.001% to 0.03%, more preferably to the range of 0.010% to 0.025%, and even more preferably to the range of 0.010% to 0.018%.

Cr: 0.01% to 0.20%

Although chromium (Cr) is slightly effective in increasing yield strength and tensile strength by solid solution strengthening, chromium (Cr) has an effect of preventing a decrease in strength by slowing the decomposition of cementite during tempering or PWHT.

To this end, it may be preferable to add chromium (Cr) in an amount of 0.01% or greater. However, if the content of chromium (Cr) exceeds 0.20%, the size and fraction of Cr-rich coarse carbides such as $M_{23}C_6$ are increased to result in a great decrease in impact toughness. In addition, manufacturing costs may increase, and weldability may decrease.

Therefore, according to the present disclosure, it may be preferable that the content of chromium (Cr) be limited to the range of 0.01% to 0.20%.

Mo: 0.05% to 0.15%

Like chromium (Cr), molybdenum (Mo) is effective in preventing a decrease in strength during tempering or PWHT and also effective in preventing a decrease in toughness caused by segregation of impurities such as phosphorus (P) along grain boundaries. In addition, molybdenum (Mo) increases the strength of a matrix by functioning as a solid solution strengthening element in ferrite.

To this end, it is preferable to add molybdenum (Mo) in an amount of 0.05% or greater. However, if molybdenum (Mo) is added in an excessively large amount, manufacturing costs may increase because molybdenum (Mo) is an expensive element. Thus, it may be preferable to set the upper limit of the content of molybdenum (Mo) to be 0.15%.

Cu: 0.02% to 0.50%

Copper (Cu) is an effective element in the present disclosure because copper (Cu) remarkably improves the strength of a matrix by inducing solid solution strengthening in ferrite and also suppresses corrosion in a wet hydrogen sulfide atmosphere.

To sufficiently obtain the above-mentioned effects, it may be preferable to add copper (Cu) in an amount of 0.02% or greater. However, if the content of copper (Cu) exceeds 0.50%, there is a high possibility that star cracks are formed in the surface of steel, and manufacturing costs may increase because copper (Cu) is an expensive element.

Therefore, according to the present disclosure, it may be preferable to limit the content of copper (Cu) to the range of 0.02% to 0.50%, more preferably to the range of 0.05% to 0.35%, and even more preferably to the range of 0.1% to 0.25%.

Ni: 0.05% to 0.50%

Nickel (Ni) is a key element for increasing strength because nickel (Ni) improves impact toughness and hardenability by increasing stacking faults at low temperatures and thus facilitating cross slip at dislocations.

To this end, nickel (Ni) is preferably added in an amount of 0.05% or greater. However, if the content of nickel (Ni) exceeds 0.50%, hardenability may excessively increase, and manufacturing costs may increase because nickel (Ni) is more expensive than other hardenability-improving elements.

Therefore, according to the present disclosure, the content of nickel (Ni) may be preferably limited to the range of 0.05% to 0.50%, more preferably to the range of 0.10% to 0.40%, and even more preferably to the range of 0.10% to 0.30%.

Ca: 0.0005% to 0.0040%

If calcium (Ca) is added after deoxidation by aluminum (Al), calcium (Ca) combines with sulfur (S) which may form MnS inclusions, and thus suppresses the formation of MnS inclusions. Along with this, calcium (Ca) forms spherical CaS and thus suppresses HIC.

In the present disclosure, it may be preferable to add calcium (Ca) in an amount of 0.0005% or greater so as to sufficiently convert sulfur (S) into CaS. However, if calcium (Ca) is excessively added, calcium (Ca) remaining after forming CaS may combine with oxygen (O) to form coarse oxide inclusions which may be elongated and fractured to cause HIC during a rolling process. Therefore, it may be preferable to set the upper limit of the content of calcium (Ca) to be 0.0040%.

Therefore, according to the present disclosure, it may be preferable that the content of calcium (Ca) be within the range of 0.0005% to 0.0040%.

The steel of the present disclosure may further include nitrogen (N). Nitrogen (N) has an effect of improving CGHAZ toughness because nitrogen (N) forms precipitates by combining with titanium (Ti) when steel (steel sheet) is welded by a single pass high heat input welding method such as electro gas welding (EGW). To this end, it may be preferable that the content of nitrogen (N) be within the range of 0.0020% to 0.0060% (20 ppm to 60 ppm).

The pressure vessel steel includes iron (Fe) besides the above-described alloying elements. However, impurities of raw materials or manufacturing environments may be inevitably included in the pressure vessel steel, and such impurities may not be removed from the pressure vessel steel. Such impurities are well-known to those of ordinary skill in the art, and thus descriptions thereof will not be presented in the present disclosure.

The pressure vessel steel of the present disclosure having the above-described alloying composition may have a microstructure in which a hard phase is formed as a matrix. Preferably, the pressure vessel steel may include bainite having a near-matrix dislocation density of $5\times10^{14}$ to $10^{15}/m^2$ (hereinafter referred to as low-dislocation-density bainite") in a fraction of 80% or greater, and the balance of ferrite.

If the fraction of the low-dislocation-density bainite is less than 80%, dislocations function as hydrogen atom trapping sites before PWHT, and thus HIC resistance may not be guaranteed. In addition, dislocations may rapidly recover after PWHT, and thus proper strength may not be guaranteed.

The ferrite refers to polygonal ferrite, and the bainite refers to upper bainite and granular bainite. In addition, the low-dislocation-density bainite may include acicular ferrite.

In the microstructure of the pressure vessel steel of the present disclosure, Nb(C,N) or V(C,N) carbonitride having a diameter of 5 nm to 30 nm may be included in an amount of 0.01% to 0.02% after PWHT. Specifically, the pressure vessel steel of the present disclosure may include only one or both of Nb(C,N) carbonitride and V(C,N) carbonitride.

The carbonitrides have an effect of preventing a decrease in strength by obstructing interfacial movement of bainite during a heat treatment such as PWHT, and therefore, it may be preferable that each of the carbonitrides be included in an amount of 0.01% or greater. However, if the fraction of each of the carbonitrides exceeds 0.02%, the fraction of a hard phase such as MA or martensite increases in weld heat affected zones, and impact toughness may not be properly guaranteed in weld zones.

Although the low-dislocation-density bainite is included in an amount of 80% or greater as described above, if plate-shaped cementite exists along interfaces of the low-dislocation-density bainite after stress relieving heat treatment or PWHT, the plate-shaped cementite may function as initiation points of HIC. Thus, spherical cementite is desirable.

The pressure vessel steel of the present disclosure satisfying the above-described alloying composition and microstructure has high HIC resistance (refer to CLR evaluation results in Table 3 below).

Hereinafter, a method for manufacturing a pressure vessel steel having high HIC resistance will be described in detail according to another aspect of the present disclosure.

Briefly, the pressure vessel steel having desired properties may be manufactured by preparing a steel slab having the above-described alloying composition, and performing "reheating, rough rolling, finish hot rolling, cooling, and maintaining processes" on the steel slab.

Reheating of Slab

First, preferably, a slab having the alloying composition proposed in the present disclosure may be reheated to a temperature of 1150° C. or greater. The first reason of the reheating is for resolving Ti or Nb carbonitrides or coarsely crystallized TiNb(C,N) which are formed during a casting process, and the second reason of the reheating is for maximizing the size of austenite grains by heating austenite to a temperature equal to higher than an austenite recrystallization temperature and maintaining the austenite at the temperature after a sizing process.

However, if the slab is reheated to an excessive high temperature, high-temperature, problems may occur due to oxide scale formed at high temperatures, and manufacturing costs may excessively increase for heating and maintaining. Thus, it may be preferable that the slab is reheated to a temperature of 1200° C. or less.

Rough Rolling

The reheated slab is subjected to rough rolling preferably at a temperature equal to or higher than a temperature Tnr at which recrystallization of austenite stops. Owing to the rough rolling, cast structures such as dendrites formed during a casting process may be broken, and the grain size of austenite may be reduced. Preferably, the rough rolling may be performed within the temperature range of 900° C. to 1100° C.

In the present disclosure, when the rough rolling is performed within the above-described temperature range, it may be preferable that the reduction ratio in each of the last three passes be adjusted to be 10% or greater and the total reduction ratio be adjusted to be 30% or greater, so as to obtain a fine central microstructure and maximally press pores remaining in the slab.

During the rough rolling, a microstructure recrystallized by initial rolling undergoes grain growth. However, since a bar is air cooled while waiting for rolling in the last three passes, the rate of grain growth decreases, and thus the reduction ratios in the last three passes of the rough rolling have the greatest effect on the grain size of a final microstructure.

In addition, if the reduction ratio per pass is low in the last three passes, deformation may not be sufficiently transmitted to a center portion, and thus toughness may decrease due to center coarsening.

Therefore, in the present disclosure, during the rough rolling, it may be preferable to adjust the reduction ratio per pass in the last three passes to be 10% or greater and the total reduction ratio to be 30% or greater.

Finish Hot Rolling

A bar obtained by the rough rolling as described above is subjected to a finish hot rolling process to manufacturing a hot-rolled steel sheet. At this time, preferably, the finish hot rolling process may be performed within the temperature range of Ar3 (ferrite transformation start temperature)+80° C. to Ar3+300° C.

In general, finish hot rolling is performed at a temperature just above Ar3 to form many deformation bands in austenite so as to reduce nucleation sites of ferrite and the packet size of bainite and thus to obtain a fine microstructure. However, when defects such as oxide inclusions are present in a slab, the microstructure of the slab may be broken due to large deformation in a rolling process, and in this case, notch portions may function as crack initiation points because stress concentrates in the notch portions due to the partial pressure of hydrogen.

Thus, in the present disclosure, both the temperature at which austenite grain refinement occurs and the temperature at which oxide inclusions are broken are considered, and the finish hot rolling temperature may preferably be adjusted to be within the above-described temperature range. If the finish hot rolling temperature is greater than Ar3+300° C., grain refinement may not effectively occur.

In addition, preferably, the total reduction ratio of the finish hot rolling may be adjusted to be 30% or greater, and the reduction ratio per pass may be adjusted to be 10% or greater except the final pass for shape adjustment, so as to form pancake-shaped austenite, that is, to effectively form many deformation bands in austenite.

The hot-rolled steel sheet obtained by the above-described finish hot rolling process may have a thickness of 6 mm to 100 mm, more preferably 6 mm to 80 mm, and even more preferably 6 mm to 65 mm.

Cooling

The hot-rolled steel sheet manufactured as described above is cooled preferably to the temperature range of 450° C. to 500° C.

At this time, the cooling may be performed at different cooling rates for different thicknesses, and may preferably be performed at an average cooling rate of 3° C./s to 200° C./s based on a point ¼t of the hot-rolled steel sheet (where t refers to the thickness of the hot-rolled steel sheet in millimeters (mm)).

If the cooling end temperature is lower than 450° C., low-dislocation-density bainite may not be sufficiently formed, but general high-dislocation-density bainite having a dislocation density of greater than $5\times10^{15}/m^2$ may be formed to result in markedly poor HIC resistance when the steel sheet is used as a base metal. In addition, even after PWHT, strength may decrease because dislocations recover, and thus a tensile strength of less than 550 MPa may only be guaranteed. Conversely, if the cooling end temperature exceeds 500° C., sufficient strength may not be guaranteed because the fraction of ferrite exceeds 20%.

In addition, if the average cooling rate is less than 3° C./s, the microstructure of the steel sheet may not be properly formed. In addition, the upper limit of the average cooling rate may preferably be set to be 200° C./s by considering process facilities. More preferably, the average cooling rate may be set to be within the range of 35° C./s to 150° C./s, and even more preferably within the range of 50° C./s to 100° C./s.

Maintaining

After the cooling, it may be preferable to cool the steel sheet to a temperature range of 200° C. to 250° C. by an ordinary stack cooling method, and then maintain the steel sheet within the temperature range for 80 hours to 120 hours. More preferably, the stack cooling may be performed preferably at a rate of 0.1° C./s to 1.0° C./s based on the center, that is, a point ½t of the hot-rolled steel sheet (where t denotes the thickness of the hot-rolled steel sheet in millimeters (mm)).

In the present disclosure, as described above, the hot-rolled steel sheet is maintained after the stack cooling, and thus the amount of hydrogen in the hot-rolled steel sheet may be sufficiently lowered. In general, the content of hydrogen in a hot-rolled steel sheet obtained through hot rolling and cooling is within the range of 2.0 ppm to 3.0 ppm, and such hydrogen existing in a hot-rolled steel sheet causes fine cracks after a certain period of time, that is, delayed fracture. Such internal defects of steel function as crack initiation points in a HIC test and markedly worsen HIC characteristics of a hot-rolled steel sheet.

Therefore, in the present disclosure, after the hot-rolled steel sheet is cooled to the above mentioned temperature range by stack cooling, the hot-rolled steel sheet may be maintained preferably for 80 hours to 120 hours.

As described above, according to the present disclosure, the contents of Mn, Ni, Mo, Cu, and Si, which have a high ferrite solid solution strengthening effect, are optimized to increase the strength of the pressure vessel steel, and along with this, the contents of elements such as C, Nb, and V, which are effective in forming carbonitrides are optimized to improve strength and toughness after PWHT. Among these elements, Mn, Ni, and V are effective in improving hardenability, and owing to improvements in hardenability of the pressure vessel steel, when a steel sheet formed of the pressure vessel steel and having a thickness of 100 mm or less is cooled (after hot rolling), a dual phase (low-dislocation-density bainite and ferrite) may be formed uniformly to the center of the steel sheet.

Hereinafter, the present disclosure will be described more specifically through examples. However, the following examples should be considered in a descriptive sense only and not for purposes of limitation. The scope of the present invention is defined by the appended claims, and modifications and variations may be reasonably made therefrom.

MODE FOR INVENTION

Examples

After steel slabs having a thickness of 300 mm and the compositions shown in Table 1 below were prepared, the steel slabs were reheated to a temperature of 1150° C., and then rough rolled within the temperature range of 900° C. to 1100° C. to manufacture bars. At that time, the total reduction rate in the rough rolling was set to be 47% based on a 60 mm thick steel sheet, and the bars had a thickness of 193 mm. In addition, the reduction ratio per pass was 10% to 13% in each of the last three passes in the rough rolling, and the deformation rate of the rough rolling was within the range of 1.0/s to 1.7/s.

Hot-rolled steel sheets were manufactured by performing a finish hot rolling process on the bars obtained by the rough rolling at a finish hot rolling temperature as shown in Table 2 below in which the difference between the finish hot rolling temperature and Ar3 is shown, and then the hot-rolled steels sheet were cooled at a rate of 3° C./s to 80° C./s to the cooling end temperatures shown in Table 2 below. Thereafter, the hot-rolled steel sheets were cooled at a rate of 0.1° C./s to 1.0° C./s to maintaining temperatures shown in Table 2 below by a stack cooling method, and then the hot-rolled steel sheets were maintained at the maintaining temperatures for periods of time shown in Table 2 below.

After the maintaining process, the hot-rolled steel sheets were observed to measure the volume fractions of microstructures, and near-matrix dislocation density was quantitatively measured. Results of the measurements are shown in Table 3 below.

In addition, after performing PWHT on the hot-rolled steel sheets, the fractions and average diameters of carbonitrides of each of the hot-rolled steel sheets were measured as shown in Table 3 below. At that time, the PWHT was performed as follows. After the hot-rolled steel sheets were heated up to 425° C., the hot-rolled steel sheets were heated to a temperature of 595° C. to 630° C. at a temperature increase rate of 55° C./hr to 100° C./hr, maintained at the temperature for 60 hours to 180 hours, cooled to 425° C. at the same rate as the temperature increase rate, and then air-cooled to room temperature. The final heating temperature and maintaining period of time are shown in Table 2 below.

In addition, Table 3 below shows tensile strength values and crack length ratios (CLRs) among HIC evaluation results which were measured after the PWHT.

Here, the crack length ratio (CLR, %) being a hydrogen induced crack length ratio in the length direction of a steel sheet was used as an HIC resistance index and measured according to relevant international standard NACE TM0284 by immersing, for 96 hours, a specimen in 5% NaCl+0.5% $CH_3COOH$ solution saturated with $H_2S$ gas at 1 atmosphere, measuring the lengths and areas of cracks by an ultrasonic test method, and dividing the total length of the cracks in the length direction of the specimen and the total area of the cracks respectively by the total length and total area of the specimen.

Microstructure fractions in each of the steel sheets were measured using an image analyzer after capturing images at magnifications of 100 times and 200 times using an optical microscope. Carbonitrides were measured as follows: the fraction and diameter of Nb(C,N) precipitate were measured by carbon extraction replica technique and transmission electron microscopy (TEM), the crystal structure of V(C,N) precipitate was observed by TEM diffraction analysis, and the distribution, fraction, and size of the V(C,N) precipitate were measured by atom probe tomography (APM).

TABLE 1

| | Alloying composition (wt %) | | | | | | | | | | | | | |
|---|---|---|---|---|---|---|---|---|---|---|---|---|---|---|
| No. | C | Si | Mn | Al | P* | S* | Nb | V | Ti | Cr | Mo | Cu | Ni | Ca* |
| IS1 | 0.15 | 0.30 | 1.20 | 0.031 | 80 | 10 | 0.012 | 0.015 | 0.012 | 0.05 | 0.07 | 0.13 | 0.25 | 13 |
| IS2 | 0.17 | 0.31 | 1.10 | 0.027 | 90 | 8 | 0.010 | 0.015 | 0.015 | 0.10 | 0.07 | 0.10 | 0.30 | 12 |
| IS3 | 0.11 | 0.25 | 1.21 | 0.033 | 70 | 6 | 0.007 | 0.025 | 0.014 | 0.07 | 0.10 | 0.17 | 0.31 | 20 |
| IS4 | 0.18 | 0.32 | 1.05 | 0.035 | 50 | 7 | 0.009 | 0.020 | 0.013 | 0.13 | 0.06 | 0.10 | 0.27 | 17 |

TABLE 1-continued

| No. | Alloying composition (wt %) | | | | | | | | | | | | | |
|---|---|---|---|---|---|---|---|---|---|---|---|---|---|---|
| | C | Si | Mn | Al | P* | S* | Nb | V | Ti | Cr | Mo | Cu | Ni | Ca* |
| IS5 | 0.16 | 0.36 | 1.03 | 0.036 | 60 | 9 | 0.016 | 0.015 | 0.015 | 0.15 | 0.07 | 0.16 | 0.36 | 15 |
| CS1 | 0.04 | 0.31 | 1.23 | 0.031 | 60 | 8 | 0.009 | 0.016 | 0.015 | 0.15 | 0.12 | 0.12 | 0.20 | 15 |
| CS2 | 0.16 | 0.33 | 0.41 | 0.030 | 80 | 10 | 0.012 | 0.012 | 0.013 | 0.05 | 0.06 | 0.19 | 0.22 | 16 |
| CS3 | 0.13 | 0.28 | 1.13 | 0.029 | 70 | 5 | 0.0003 | 0.0001 | 0.012 | 0.09 | 0.06 | 0.12 | 0.22 | 17 |
| CS4 | 0.15 | 0.85 | 1.15 | 0.035 | 80 | 10 | 0.012 | 0.017 | 0.015 | 0.15 | 0.08 | 0.18 | 0.39 | 15 |
| CS5 | 0.17 | 0.33 | 1.00 | 0.025 | 90 | 10 | 0.019 | 0.007 | 0.012 | 0.08 | 0.05 | 0.73 | 0.18 | 17 |
| IS6 | 0.11 | 0.21 | 1.10 | 0.027 | 80 | 8 | 0.015 | 0.012 | 0.010 | 0.05 | 0.07 | 0.05 | 0.13 | 13 |
| IS7 | 0.13 | 0.29 | 1.00 | 0.035 | 60 | 7 | 0.012 | 0.013 | 0.012 | 0.02 | 0.05 | 0.07 | 0.18 | 17 |
| IS8 | 0.18 | 0.31 | 1.05 | 0.015 | 50 | 6 | 0.008 | 0.014 | 0.015 | 0.05 | 0.08 | 0.09 | 0.15 | 15 |
| IS9 | 0.18 | 0.30 | 1.09 | 0.08 | 50 | 7 | 0.009 | 0.015 | 0.015 | 0.05 | 0.09 | 0.08 | 0.15 | 15 |

IS: Inventive Steel,
CS: Comparative steel (In Table 1 above, the content of an element indicated with the symbol "*" is in ppm. In addition, the content of nitrogen (N) in each steel is within the range of 20 ppm to 60 ppm, and thus the content of nitrogen (N) is not shown.)

TABLE 2

| Steels | Hot rolling: Finish hot rolling temp.(° C.)-Ar3 | Hot rolling: Cooling end temp. (° C.) | Hot-rolled steel sheet thickness (mm) | Maintaining (in a stack) Temp. (° C.) | Maintaining (in a stack) Time (Hr) | PWHT Temp. (° C.) | PWHT Time (Hr) | No. |
|---|---|---|---|---|---|---|---|---|
| IS1 | 90 | 462 | 10.58 | 220 | 93 | 595 | 65 | IE1 |
| IS2 | 102 | 468 | 25.93 | 210 | 85 | 595 | 66 | IE2 |
| IS3 | 115 | 475 | 45.69 | 233 | 86 | 602 | 80 | IE3 |
| IS4 | 120 | 481 | 62.12 | 225 | 90 | 601 | 95 | IE4 |
| IS5 | 135.2 | 490 | 83.97 | 231 | 112 | 610 | 68 | IE5 |
| CS1 | 95.8 | 465 | 19.3 | 222 | 115 | 605 | 102 | CE1 |
| CS2 | 97.4 | 465 | 20.5 | 215 | 100 | 620 | 98 | CE2 |
| CS3 | 104.3 | 470 | 50.7 | 216 | 115 | 621 | 75 | CE3 |
| CS4 | 97.5 | 466 | 20.7 | 213 | 95 | 596 | 73 | CE4 |
| CS5 | 111.2 | 474 | 40.6 | 215 | 96 | 599 | 84 | CE5 |
| IS6 | 13.7 | 153.2 | 25.92 | 250 | 94 | 605 | 81 | CE6 |
| IS7 | −25.4 | 477 | 42.56 | 245 | 90 | 608 | 80 | CE7 |
| IS8 | 127.3 | 615 | 85.5 | 212 | 88 | 611 | 75 | CE8 |
| IS9 | 88 | 468 | 43 | 229 | 12 | 601 | 88 | CE9 |

IS: Inventive Steel,
CS: Comparative steel,
IE: Inventive Example,
CE: Comparative Example

TABLE 3

| No. | Microstructure (before PWHT) F (%) | AF + B (%) | Dislocation density ($10^{14}/m^2$) | Precipitates (after PWHT) Nb(C, N) Fraction (wt %) | Nb(C, N) Size (nm) | V(C, N) Fraction (wt %) | V(C, N) Size (nm) | Tensile strength Before PWHT (MPa) | After PWHT (MPa) | HIC properties CLR (%) | Surface shape |
|---|---|---|---|---|---|---|---|---|---|---|---|
| IE1 | 1.6 | 98.4 | 9.4 | 0.017 | 28 | 0.015 | 11 | 654.6 | 632.5 | 0 | Good |
| IE2 | 8.8 | 91.2 | 7.5 | 0.019 | 17 | 0.016 | 10 | 629.3 | 590.6 | 0 | Good |
| IE3 | 11.7 | 88.3 | 6.4 | 0.010 | 21 | 0.019 | 11 | 620.7 | 588.4 | 0 | Good |
| IE4 | 14.4 | 85.6 | 5.6 | 0.015 | 16 | 0.018 | 11 | 615.8 | 589.2 | 0 | Good |
| IE5 | 15.8 | 84.2 | 5.3 | 0.018 | 21 | 0.015 | 10 | 591.1 | 579.3 | 0 | Good |
| CE1 | 31.5 | 68.5 | 8.3 | 0.011 | 12 | 0.009 | 8 | 500.8 | 488.2 | 0 | Good |
| CE2 | 26.9 | 73.1 | 8.2 | 0.015 | 15 | 0.017 | 10 | 511.7 | 492.3 | 0 | Good |
| CE3 | 8 | 92 | 7.5 | — | — | — | — | 589.5 | 544.3 | 0 | Good |
| CE4 | 5.7 | 94.3 | 8.3 | 0.021 | 15 | 0.021 | 14 | 690.7 | 677.4 | 18.5 | Good |
| CE5 | 10.6 | 89.4 | 6.8 | 0.019 | 17 | 0.019 | 10 | 630.5 | 602.4 | 0 | Start cracks |
| CE6 | 6.9 | 93.1 | 89 | 0.011 | 18 | 0.013 | 12 | 657.2 | 640.8 | 17.3 | Good |
| CE7 | 9.8 | 90.2 | 93 | 0.015 | 21 | 0.015 | 11 | 700.4 | 689.3 | 20.4 | Shape defects |

TABLE 3-continued

| | Microstructure (before PWHT) | | | Precipitates (after PWHT) | | | | Tensile strength | | HIC | |
|---|---|---|---|---|---|---|---|---|---|---|---|
| | | | Dislocation | Nb(C, N) | | V(C, N) | | Before | After | properties | |
| No. | F (%) | AF + B (%) | density ($10^{14}/m^2$) | Fraction (wt %) | Size (nm) | Fraction (wt %) | Size (nm) | PWHT (MPa) | PWHT (MPa) | CLR (%) | Surface shape |
| CE8 | 12.5 | 87.5 | 5 | 0.017 | 20 | 0.016 | 13 | 511.8 | 491.4 | 15.4 | Good |
| CE9 | 12.9 | 88.3 | 9.5 | 0.018 | 16 | 0.013 | 11 | 650.3 | 625.7 | 18 | Good |

IE: Inventive Example,
CE: Comparative Example (In Table 3 above, F refers to ferrite, AF refers to acicular ferrite, and B refers to bainite. Furthermore, in Table 3 above, dislocation density refers to a value measured near an AF+B matrix. In each of Comparative Examples 4 and 8 shown in Table 3 above, MA was present in a certain fraction in the AF+B matrix.)

As shown in Tables 1 to 3 above, Comparative Example 1 had an insufficient content of carbon (C) compared to the carbon content proposed in the present disclosure and thus had a low bainite fraction due to poor hardenability. In addition, since Comparative Example 1 had polygonal ferrite in a fraction of greater than 20%, Comparative Example 1 had a low tensile strength on the level of 500.8 MPa not only after the PWHT but also before the PWHT.

Comparative Example 2 having an insufficient Mn content had polygonal ferrite in a fraction of greater than 20% because of insufficient hardenability. Thus, Comparative Example 2 had a tensile strength of less than 550 MPa before and after the PWHT.

Comparative Example 3 having an insufficient Nb content and an insufficient V content had very good tensile strength before the PWHT and very good HIC characteristics. However, due to very low fractions of Nb(C,N) and V(C,N) carbonitrides (too low to measure), Comparative Example 3 had a great decrease in strength after the PWHT and thus did not satisfy the lower strength limit value of 550 MPa required in the present disclosure.

Comparative Example 4 had an excessively high Si content and was thus markedly affected by solid solution strengthening. In addition, since MA was formed during the air cooling after the cooling, Comparative Example 4 had excessively high tensile strength before and after the PWHT and also had poor HIC characteristics due to the formation of MA.

Comparative Example 5 having an excessively high Cu content had an increase in ferrite solid solution strengthening because of Cu and thus somewhat increased in tensile strength compared to Inventive Examples. However, the tensile strength of Comparative Example 5 was within the range required in the present disclosure, and the impact toughness of Comparative Example 5 was within the range required in the present disclosure. However, star cracks appeared on the surface of Comparative Example 5. That is, Comparative Example 5 had low surface quality.

Comparative Example 6 was subjected to the finish hot rolling at a temperature just above an Ar3 transformation point, and was over cooled to 153.2° C. without satisfying the cooling end temperature proposed in the present disclosure. Therefore, Comparative Example 6 had excessively high matrix dislocation density and thus poor HIC resistance.

Comparative Example 7 was rolled in a dual phase region during the finish hot rolling and thus had dislocation density higher than that of Comparative Example 6, thereby having shape defects, excessively high tensile strength before and after the PWHT, and poor HIC resistance.

Comparative Example 8 was cooled to a relatively high cooling end temperature, and thus MA was formed in Comparative Example 8 because of the incomplete cooling. Thus, Comparative Example 8 had poor HIC resistance.

During the stack cooling, Comparative Example 9 was not maintained for a given period of time within the temperature range proposed in the present disclosure. Thus, Comparative Example 9 had poor HIC resistance.

However, in each of Inventive Examples 1 to 5 which satisfied all the alloying composition and manufacturing conditions proposed in the present disclosure, low-dislocation-density bainite was formed in a microstructure in a fraction of 80% or greater, and carbonitrides were also sufficiently formed after the PWHT. Therefore, Inventive Examples 1 to 5 had tensile strength within the range of 550 MPa to 670 MPa, satisfactory surface quality, and high HIC resistance.

Figure 1B:
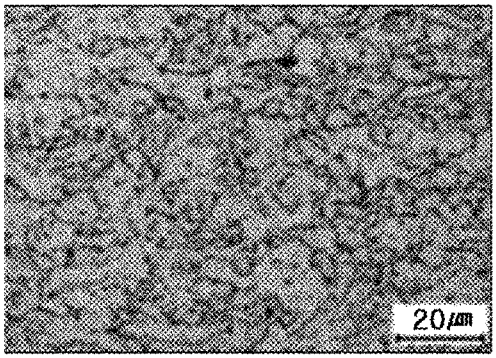

FIGS. 1A and 1B show images of the microstructures of Comparative Example 6 (FIG. 1A) and Inventive Example 5 (FIG. 1B).

In Comparative Example 6 having low-dislocation-density bainite in a fraction of less than 80%, fine bainite was formed because the cooling end temperature of Comparative Example 6 was set to be a low value. However, since Inventive Example 5 was cooled to a cooling end temperature satisfying the range proposed in the present disclosure and had low-dislocation-density bainite in a fraction of 80% or greater, Inventive Example 5 had a greater grain size than Comparative Example 6, but very lower dislocation density than Comparative Example 6 owing to a recovery phenomenon.

The invention claimed is:

1. A pressure vessel steel having high resistance to hydrogen induced cracking, the pressure vessel steel comprising, by wt %, carbon (C): 0.06% to 0.25%, silicon (Si): 0.05% to 0.50%, manganese (Mn): 1.0% to 2.0%, aluminum (Al): 0.005% to 0.40%, phosphorus (P): 0.010% or less, sulfur (S): 0.0015% or less, niobium (Nb): 0.001% to 0.03%, vanadium (V): 0.001% to 0.03%, titanium (Ti): 0.001% to 0.03%, chromium (Cr): 0.01% to 0.20%, molybdenum (Mo): 0.05% to 0.15%, copper (Cu): 0.02% to 0.50%, nickel (Ni): 0.05% to 0.50%, calcium (Ca): 0.0005% to 0.0040%, and the balance of iron (Fe) and inevitable impurities, wherein the pressure vessel steel has a microstructure comprising bainite having a dislocation density of $5\times10^{14}$ to $10^{15}/m^2$ in a volume fraction of 80% or greater and the balance of ferrite (excluding 0%), and wherein after post weld heat treatment (PWHT), the microstructure of the pressure vessel steel comprises Nb(C,N) or V(C,N) carbonitride having a diameter of 5 nm to 30 nm in an amount of 0.001% to 0.002%.

2. The pressure vessel steel of claim 1, wherein the bainite comprises acicular ferrite.

3. The pressure vessel steel of claim 1, wherein after PWHT, the pressure vessel steel has a tensile strength of 550 MPa or greater.

4. A method for manufacturing a pressure vessel steel having high resistance to hydrogen induced cracking according to claim 1, the method comprising:

preparing a steel slab, the steel slab comprising, by wt %, carbon (C): 0.06% to 0.25%, silicon (Si): 0.05% to 0.50%, manganese (Mn): 1.0% to 2.0%, aluminum (Al): 0.005% to 0.40%, phosphorus (P): 0.010% or less, sulfur (S): 0.0015% or less, niobium (Nb): 0.001% to 0.03%, vanadium (V): 0.001% to 0.03%, titanium (Ti): 0.001% to 0.03%, chromium (Cr): 0.01% to 0.20%, molybdenum (Mo): 0.05% to 0.15%, copper (Cu): 0.02% to 0.50%, nickel (Ni): 0.05% to 0.50%, calcium (Ca): 0.0005% to 0.0040%, and the balance of iron (Fe) and inevitable impurities;

reheating the steel slab to a temperature of 1150° C. to 1200° C.;

rough rolling the reheated steel slab at a temperature of 900° C. to 1100° C.;

finish hot rolling the rough-rolled steel slab at a temperature of Ar3+80° C. to Ar3+300° C. to manufacture a hot-rolled steel sheet;

cooling the hot-rolled steel sheet to a temperature of 450° C. to 500° C. at a cooling rate of 3° C./s to 200° C./s; and cooling the cooled hot-rolled steel sheet to a temperature of 200° C. to 250° C. by a stack cooling method and then maintaining the hot-rolled steel sheet for 80 hours to 120 hours.

5. The method of claim 4, wherein the rough rolling is performed at a reduction ratio of 10% or greater in each of last three passes and a total reduction ratio of 30% or greater.

6. The method of claim 4, wherein the cooling of the cooled hot-rolled steel sheet by the stack cooling method is performed at a cooling rate of 0.1° C./s to 1.0° C./s.

* * * * *